US005476178A

United States Patent [19]

Lamort

[11] Patent Number: 5,476,178

[45] Date of Patent: Dec. 19, 1995

[54] ROTOR FOR PRESSURIZED HYDRODYNAMIC PURIFICATION OF PAPER PULP AND EQUIPMENT FITTED WITH THIS ROTOR

[75] Inventor: Jean-Pierre Lamort, Saint Amand Sur Fion, France

[73] Assignee: E & M Lamort, Vitry Le Francois, France

[21] Appl. No.: 261,136

[22] Filed: Jun. 14, 1994

[30] Foreign Application Priority Data

Jun. 16, 1993 [FR] France ..... 93 07242

[51] Int. Cl.[6] ..... B07B 1/20; B07B 1/50

[52] U.S. Cl. ..... 209/273; 209/300; 209/379; 210/415

[58] Field of Search ..... 209/273, 281, 209/283, 300, 305, 306, 379; 210/413, 414, 415

[56] References Cited

U.S. PATENT DOCUMENTS

| | | | |
|---|---|---|---|
| 1,921,750 | 8/1933 | Heinrich et al. | 209/300 X |
| 3,726,401 | 4/1973 | Bolton, III et al. | 209/306 X |
| 4,188,286 | 2/1980 | Holz | 210/415 X |
| 4,200,537 | 4/1980 | Lamart | 209/273 X |
| 4,447,320 | 5/1984 | Lamart | 209/300 X |
| 4,744,894 | 5/1988 | Gauld | 209/273 X |

FOREIGN PATENT DOCUMENTS

| | | | |
|---|---|---|---|
| 206975 | 12/1986 | European Pat. Off. . | |
| 275921A2 | 1/1987 | European Pat. Off. . | |
| 473975 | 3/1992 | European Pat. Off. | 210/415 |
| 1472743 | 3/1966 | France . | |
| 1546515 | 10/1968 | France . | |
| 2005590 | 12/1969 | France . | |
| 2410081 | 11/1977 | France . | |

*Primary Examiner*—William E. Terrell
*Assistant Examiner*—Tuan Nguyen
*Attorney, Agent, or Firm*—Lowe, Price, LeBlanc & Becker

[57] ABSTRACT

The invention concerns a rotor for the pressurized, hydrodynamic purification of paper pulp from old papers in known purifying equipment comprising a cylindrical screen, characterized in that it comprises a generally cylindrical case extending along a longitudinal axis of rotation 6 and comprising a sequence of n identical elements 8 arrayed side-by-side along the longitudinal axis 6, the screen-side wall evincing a shoulder 14 on either side of which it winds spirally around the longitudinal axis over at least 360°, the base and the top of the shoulder subtending a very slight angular gap Ω relative to said axis in such manner that the shoulder side 14 slopes toward the screen surface, the slope angle α relative to the radial plane through the shoulder base being between 5 and 80°, the elements 8 being mutually shifted in the direction of rotation around the axis 6 by an angle β with a magnitude of at least 360°/n, where n is at least 3.

12 Claims, 3 Drawing Sheets

ROTOR FOR PRESSURIZED HYDRODYNAMIC PURIFICATION OF PAPER PULP AND EQUIPMENT FITTED WITH THIS ROTOR

FIELD OF THE INVENTION

The present invention concerns a rotor for the pressurized hydrodynamic purification of paper pulp in particular from recycled old paper, and equipment fitted with this rotor.

BACKGROUND ART

The state of the art already comprises much equipment of this sort, among which the following:

Applicant's French patent 2,410,081 comprising, within a closed tank, a cylindrical screen and a closed cylindrical rotor fitted at its periphery with blades sweeping the screen at high speeds while very close to the perforated sheetmetal. This equipment may operate either centrifugally or centripetally depending on the rotor's direction of rotation. The perforations are holes or slits depending on the nature of the pulp and impurities and the inner screen surface is smooth or contoured. in the latter case the perforations being located at the groove bottom.

The blade assumes the shape of a wedge with a radial edge and an edge sloping at 20° to 30° relative to the rotor wall. Whatever the direction of rotation, the pulp between the rotor and screen is driven into rotation with the rotor. For centrifugal operation, the radial surface perpendicular to the rotor is similar to a scraper pushing the pulp.

Several equipment of this sort are used in cascade in many plants, though individually such equipment will differ by their centrifugal/centripetal operation. Preferably, the coarse pulp from the primary disintegration treatment by pulpers will be filtered in this equipment set for centrifugal operation. The coarsest impurities (threads, nettings etc.) are then eliminated. The pulp only containing thereafter impurities of small diameters is then filtered in identical equipment set for centripetal operation.

When used in the centrifugal mode, this equipment operates at concentrations about 3 to 4% but this operation is accompanied by substantial fractionation. The pulp rotating at a speed close to that of the rotor aligns the fibers in the direction of motion in a plane parallel to the screen surface. These aligned fibers (the longest) mix with the threads and nettings and other impurities and are eliminated with the discards.

U.S. Pat. No. 3,726,401 discloses a centrifugal purification apparatus comprising a screen inside which turns a rotor constituted of eccentric lobes (relative to the longitudinal axis of the screen); illustratively the lobes are mutually eccentric, the cylinder being oval in cross-section.

The object of this rotor shape is to generate pulses precluding screen clogging: that portion of the rotor approaching the screen generates a pressure increase while the portion moving away from it causes a depression (partial vacuum).

Such a shape is well known in pump technology and entails a substantial rotation of the pulp.

In order to avert excessive fractionation, the pulp is recirculated through the hollow inside-space of the rotor. Accordingly the pulp undergoes several motions past the screen perforations.

The European patent document 206,975 is a centrifugal purifier comprising a closed rotor and designed, in the manner of that of the previous document, to be based on the lobes of an eccentric cylinder; however instead of being mutually eccentric excentric, they are sliding in mutually excentric manner whereby two cross-sectionally offset half-cylinders are created. This rotor rotates in front of a contoured screening surface similar to that described in the French patent 2,410,081. The operating principle is the same: the rotor comprises two opposite shoulders extending over the entire length of the screen and serving to drive the pulp at the rotor speed. The shoulders are scrapers. However, differing from the scraper of the above cited equipment, the rear side of the shoulder is neither planar nor sloping, instead it is cylindrical and thereby the depression generated will be less and spread over a larger peripheral surface.

The high speed imparted to the pulp endows it with a high centrifugal force contributing to higher screening outputs which are however little affected by the said depression.

While this equipment is satisfactory with respect to purification outputs, other hand it incurs the drawback of high fractionation which is merely limited by the screen contour.

Moreover, this equipment is power-intensive to set the pulp in motion. It also, requires using a screen highly resistant to mechanical stresses because of knocking from the shoulders parallel and symmetrical relative to the generatrix; the overpressures and depressions are diametrically opposite and the opposite deformations are additive. These stresses add to costs which may be quite substantial in case of malfunction.

It follows from the above description that the above purification equipment entail the main drawback of more or less substantial fractionation which is reflected both by material losses, and moreover the loss of the most valuable material, namely the long fibers used for high-grade paper manufacture.

The main object of the invention is to create equipment avoiding this fractionation.

Fractionation appears to arise mainly from the pulp rotating at a speed near that of the rotor and it is averted in centrifugal purifying equipment using open drums; such equipment is well known (for instance French patent 1,546,515) and consists of a cylindrical screen inside which a rotor rotates about its axis. This rotor consists of an axial shaft bearing arms to the ends of which are affixed cross-sectionally hydrodynamic blades.

Regarding such, i.e. the conventional purifying equipment, the pulp filling all the cylinder occupied by the rotor is made to move near the screen by the blade rotation. However, this motion is substantially less than that of the blades. and this feature is required to pulse the pulp when the blade is moving by.

The fibers subjected to such pulses cannot align themselves in the flow path of the pulp, and thereby fractionation is averted or lessened. However this purification by means of a drum with "open" rotor is unsuitable for the first purifications of very soiled pulps, nor is it suitable for high concentrations because. in spite of the pulses, the screens will rapidly clog, foremost because the impurities and the long fibers will straddle the leading edges of the blades.

SUMMARY OF THE INVENTION

The object of the present invention is to create purifying equipment allowing centrifugal or centripetal operation and primary purification by screening high-impurity pulps, and that shall offer purification at least as good as from known equipment and without fractionation.

The object of the invention is a rotor for the pressurized hydrodynamic purification of paper pulp from old papers in a known type of purifying equipment comprising a cylindrical screen, characterized by a generally cylindrical case extending along a longitudinal axis of rotation and, along this longitudinal axis comprising a sequence of side-by-side n identical cylindrical elements, the wall on the screen-side comprising a shoulder spiraling about the longitudinal axis by at least 360°, the base and the top of the shoulder being very slightly offset angularly from said axis so that the shoulder side is sloping toward the screen surface, the angle of this slope relative to the radial plane through the shoulder base being between 5° and 80°, the elements being mutually and rotationally offset by an angle β at least 360°/n, with n being at least 3.

The rotor of the invention furthermore evinces the following features:

at least one element comprises on its screen-side wall at least one deflection device serving to displace the pulp in the longitudinal direction, each element comprises at least one blade opposite the shoulder relative to the rotor axis, this blade extending on the element wall and subtending an angle δ between 1° and 15° with the plane perpendicular to the longitudinal rotor axis, the blade leading-edge slopes by an angle ϕ of about 60°, the spiraling element segment winds over at least 360°, the rotor comprises three elements offset from one another by 120°, the spiraling segment winding over 120°, the rotor comprises four elements mutually offset by 90°, the spiraling segment winding over 90°.

In a first embodiment mode of the invention, the rotor serves for centrifugal purification. This is a closed drum designed to stack n identical elements present within the screen. The slope of the shoulder is between 5° and 45°, preferably between 10° and 30°.

In a second embodiment mode of the invention, the rotor is designed for centripetal purification. The rotor encloses the screen and is a body of revolution with an outer cylindrical wall and with an inner spiraling wall as defined above. The shoulder slope is between 10° and 60°.

The invention also concerns equipment for the pressurized hydrodynamic purification of paper pulp.

The equipment is of the type comprising a closed tank containing at least one stationary cylindrical screen separating two chambers and a rotor coaxial with the screen defined anywhere above.

This equipment is further characterized in that the space between the screen and the shoulder top is between 1 and 5 min.

BRIEF DESCRIPTION OF THE DRAWINGS

The invention is elucidated below by means of two illustrative embodiment modes in relation to the attached drawing, the first mode concerning a centrifugal-purification rotor and the second mode a centripetal-purification rotor.

DESCRIPTION OF THE PREFERRED EMBODIMENTS

In a first embodiment mode of the invention, the equipment is fitted with a rotor for centrifugal purification.

Figure 1:
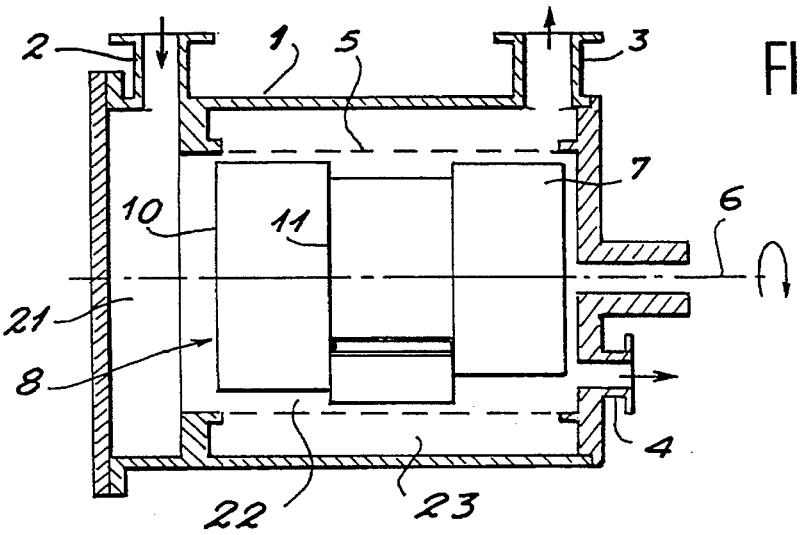
FIG. 1 is a schematic view of equipment of the invention with a centrifugal rotor.

As shown by FIG. 1, the purifying equipment comprises a closed volume 1 with a raw-pulp inlet 2, a purified-pulp outlet 3 and a discard outlet 4. A stationary cylindrical screen 5 with longitudinal axis 6 is mounted inside said volume in manner known per se. Said screen 5 defines two chambers inside the cylinder, namely a chamber 21 for the incoming pulp and an outlet chamber 23 for this incoming pulp.

A rotor 7 with a generally cylindrical case is mounted inside said volume coaxially with the screen. This rotor 7 is a closed drum which the pulp cannot enter. The rotor 7 is constituted by a plurality of coaxially side-by-side identical elements 8, namely 8.1, 8.2, 8.3, each being cylindrical overall and consisting of a wall 9 spirally winding over approximately 360° between two planar walls 10, 11 perpendicular to the axis 6. The two wall ends 12, 13 are radially offset and are joined by a preferably planar surface element 14 acting as a shoulder. Moreover the two ends 12. 13 are apart in such mariner that they subtend a minute gap Ω of about 30" to several degrees for instance, with the longitudinal axis 6. The side or plane of the shoulder 14 slopes relative to the screen surface, that is, toward the rear with respect to the radial plane 15 through the shoulder base 12 at an angle of about 10° to 30°.

Figure 5:
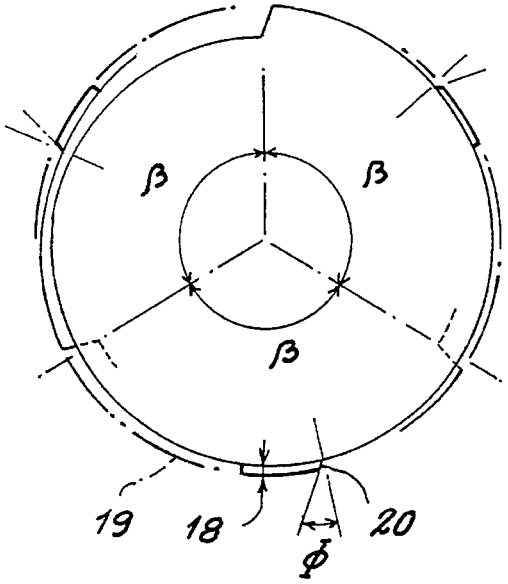
FIG. 5 is a cross-sectional view of the rotor of FIG. 4.

The rotor elements 8 are mutually offset in the direction of rotation from one another by the same angle β. In the example shown, the rotor consists of three elements 8.1, 8.2, 8.3; the shoulders are offset from one another by an angle 360° C./3, i.e. 120° (FIG. 5)

Obviously, this embodiment mode is not limitative and the rotor may consist of 4, 5 or many more elements, in which case the angular gap β would be resp. 360°/4, 360° /5 . . . etc.

Moreover, at least one deflecting device 16 shall be mounted on at least one element 8 to impart a longitudinal motion to the pulp.

Figure 4:
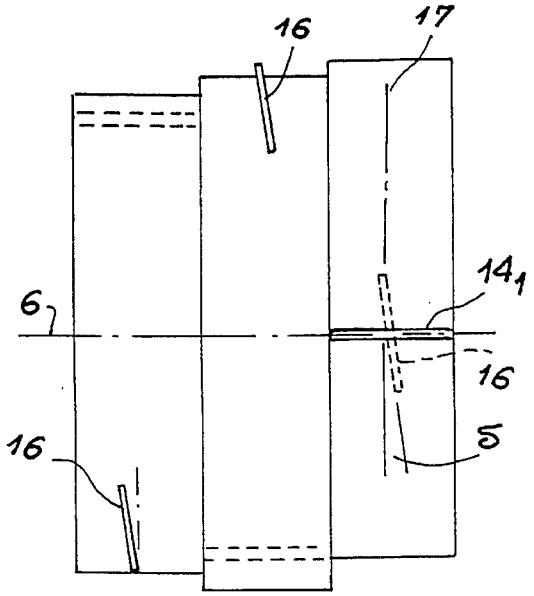
FIG. 4 is a longitudinal contour view of the rotor of the invention of FIG. 1.

In the illustrative embodiment variation shown, each element comprises such a device which assumes the shape of a blade. It is mounted on the wall 9 diametrically opposite the shoulder 14 and subtends an angle δ between 1° and 15° with the plane 17 perpendicular to the longitudinal axis 6, the magnitude of said angle being selected in particular in relation to the kind of pulp, its concentration and the screen properties and the desired longitudinal circulation speeds (FIG. 4).

The blade height 18 varies so it remains within the rotor's cylindrical generatrix 19.

The blade leading-edge 20 slopes by an angle ϕ of about 45° to 70°, in the illustrative embodiment by about 60°, in order to preclude fiber accumulation.

Figure 6:
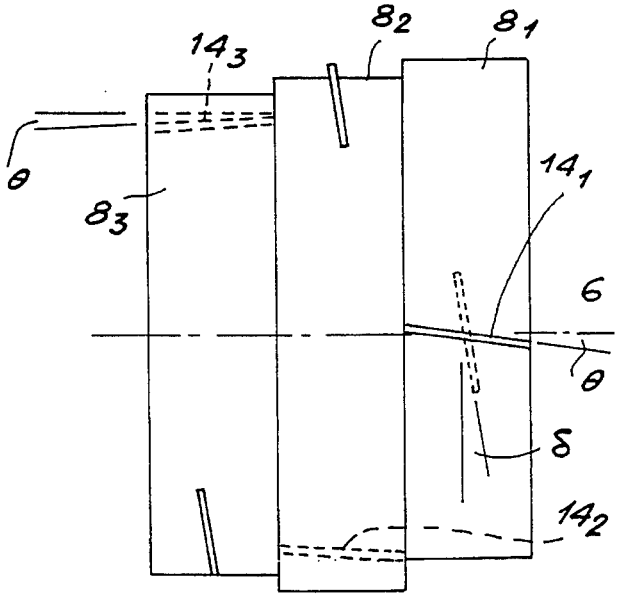
FIG. 6 is a longitudinal contour view of a variation of the rotor of FIG. 4.

As further shown in the embodiment variation of FIG. 6, the shoulders 14 may slope by an angle θ between −15° and +15° approximately relative to the longitudinal axis 6 in order to control the pulp's longitudinal motion. Any combination of slopes of the shoulders and blades 16 may be used within the scope of the invention. Illustratively the first shoulder 14.1 may slope by 7°, the second shoulder 14.2 by 0°, and the third shoulder 14.3 by −5°, the slope being the inverse in relation to the central element rotor 8.2. Such a design allows controlling the pulp dwell-time in the screening space (circulation speed).

Figure 2:
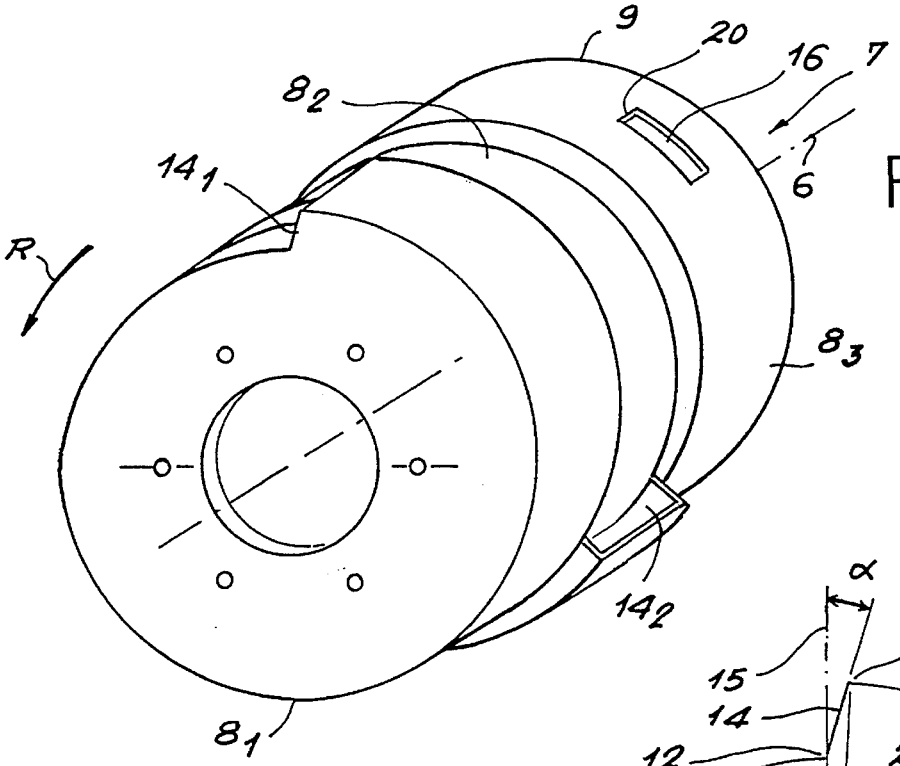
FIG. 2 is perspective of the rotor of the invention of FIG. 1.
Figure 3:
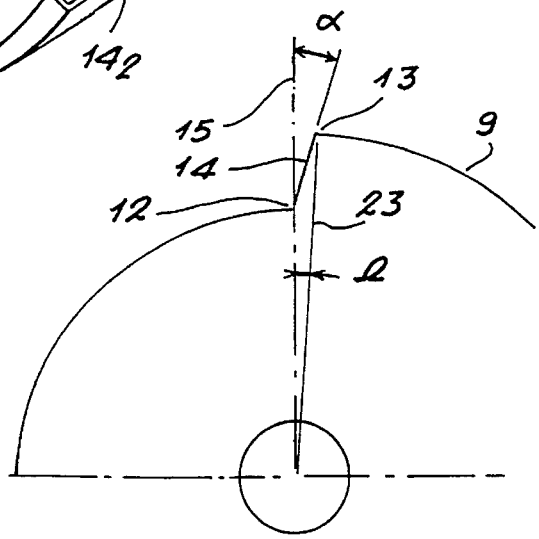
FIG. 3 is a partial schematic of the shoulder contour of a rotor element of the invention of FIG. 1.

As shown by FIG. 2, the elements are mutually offset rearward in such a way that the rotor's direction of rotation is that denoted by arrow R (the shoulder being a leading edge), the second shoulder 14.2 being behind the first shoulder 14.1 by 120° and the third shoulder being again behind by 120°.

However the reverse design also may be used without transcending the scope of the invention, in combination with the slopes of the blades and shoulders.

The equipment operates as follows: the pulp is pressurized at 2 and enters the intake chamber 21, then the screening space 22. The pulp is pushed by the sloping shoulder 14 and applied against the inner surface of the screen 5 and then is subjected to a slight and constant depression (partial vacuum) which is continuous to the shoulder return.

During said depression the pulp detaches off the screen and moves longitudinally toward the next rotor element 8 where again it is abruptly and hardly forced against the screen surface.

Accordingly, the pulp undergoes consecutive applications (one for each shoulder pass) and screening apparently is achieved by the force of these repeated pulses against the perforated surface.

The longitudinal motion can be accelerated or decelerated by means of the blades (their number, their slopes), by means of the longitudinal slopes of the shoulders and also by means of the mutual offsets of the elements (±β).

The magnitude of the slope α of the shoulder 14 is selected in such manner that on one hand jamming with the screen wall shall be precluded, an effect which may arise beyond 40°, and on the other hand the rotation of the pulp shall be maximally restricted.

In the invention, the shoulder is sloping to avoid or reduce as much as possible dragging the pulp along. The procedure is equivalent to the pulp projected by this sloping surface toward the screen being applied to and stationary on the screen. In this manner and contrary to the case of equipment of the state of the art wherein the shoulder is a scraper serving to drive the pulp at the speed of the rotor, in the invention, the shoulder slope serves the opposite purpose, namely to achieve considerable speed differentials as in the open rotors. The pulp rotational speed being much reduced. the centrifugal force also shall be much reduced, and the constant depression following the shoulder then suffices to balance this slight centrifugal force. It appears that with this, equilibrium filtration takes place solely by means of the pressure differential between the screen walls generated by the feed.

Figure 7:
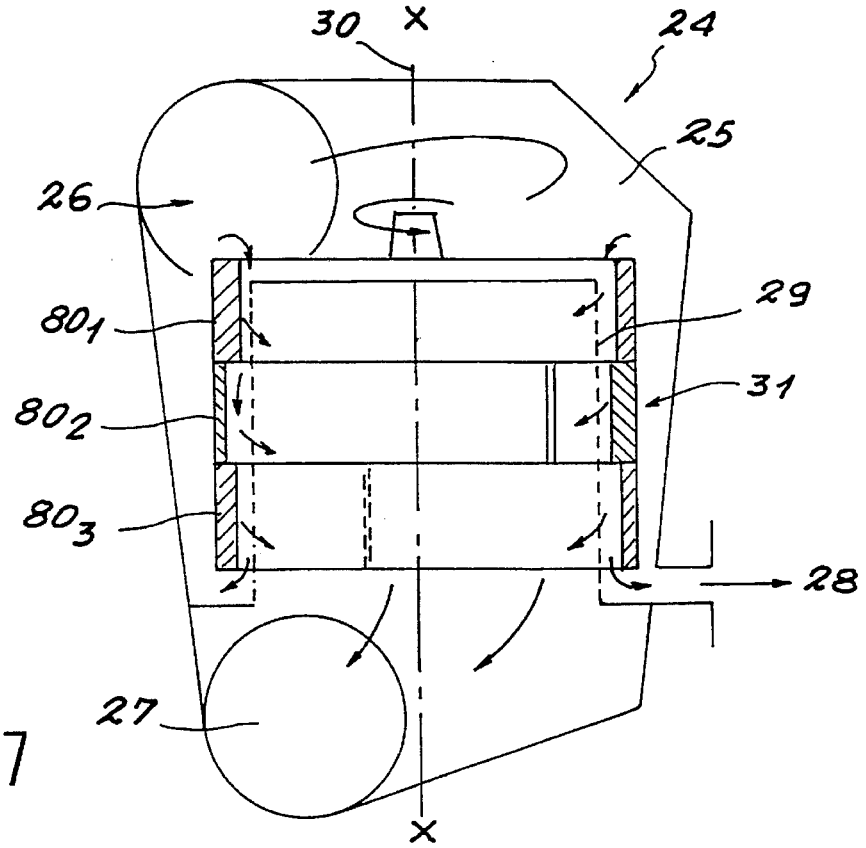
FIG. 7 is an exploded schematic of equipment of the invention fitted with a centripetal rotor.
Figure 8:
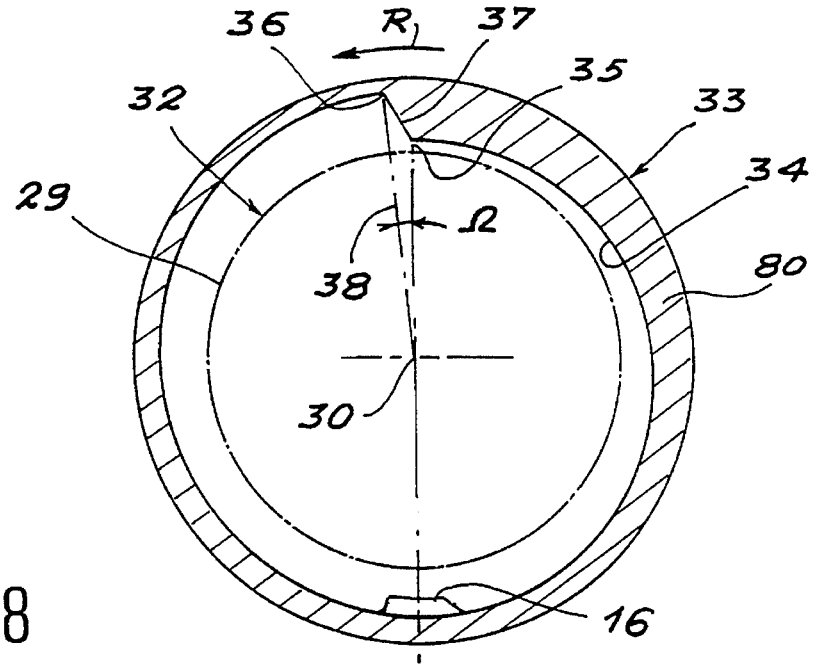
FIG. 8 is a cross-section of the rotor of the invention of FIG. 7.

In a second embodiment mode illustrated in FIGS. 7 and 8, the equipment is fitted with a rotor for centripetal purification.

The equipment 24 comprises a closed volume 25 with a raw-pulp intake 26, a purified-pulp outlet 27 and a discharge 28 for rejects. A cylindrical screen 29 with an axis of revolution 30 is affixed in this volume in stationary manner.

A generally cylindrical rotor 31 is mounted coaxially with the screen so as to be rotating about it at its outer side 32. It consists of hollow cylindrical elements 80 with solid walls. The outer side 33 of each element 80 is cylindrical and its cross-section is circular, the inner side 34 evincing a spiral cross-section over approximately 360°. The two ends 35, 36 are offset radially and offset angularly by a very small angle Ω and are joined by a preferably planar surface part 37 serving as a shoulder. The shoulder slopes relative to the screen surface, that is toward the rear relative to the radial plane 38 through the shoulder base 36, by an angle α about 10° to 60°.

As in the first embodiment mode, the rotor 31 consists of the coaxial side-by-side arrangement of a plurality of identical elements 80.1, 80.2, 80.3 which are mutually angularly offset by the same angular magnitude β relative to the axis of revolution 30.

All other features described in relation to the centrifugal rotor are applicable to the centripetal rotor.

The rotor of the invention offers many advantages of which the main ones are listed in the comparative table below for centrifugral purification of constant-quality raw pulp. The "drum" rotor is used in equipment of the sort described in the above-cited French patent 2,410,001. In each case equipment and screen dimensions are resp. identical, and so are the screens. The test results are normalized with respect to a reference rotor-drum.

TABLE

| | OUT-PUT | CONCEN-TRATION | ABSORBED PORTION | FRACTION-ATION |
|---|---|---|---|---|
| Drum rotor | 1 | 1 | 1 | Large |
| Open rotor | 1.15 | 0.9/1.0 | 0.85/0.90 | low |
| Rotor of the invention | 1.25 | 1.10 | 0.70 | very low |

The table shows that not only does the rotor of the invention purify the pulp without fractionating it, but purification is faster and thereby allows higher output, the pulp holding a higher concentration of dry material, and less power being drawn. These are the four essential purification parameters which are improved in simultaneous and considerable manner.

The tests furthermore show that screens of any contours may be used, even smooth ones, with the results being virtually unchanged.

I claim:

1. A rotor for the pressurized hydrodynamic purification of paper pulp from old papers in purification equipment using a cylindrical screen, comprising:

a generally cylindrical case extending along a longitudinal axis of rotation 6, 30 and comprising a sequence of n identical elements 8, 80 located side-by-side along the longitudinal axis 6, each element 8, 80 being cylindrical, a side wall of each element 8, 80 having a step 14, 37, said step forming a based edge 12, 35 and a top edge 13, 36, on either side of the step, the side wall gradually spirally winding around the longitudinal axis 6, 30 over at least 360° from said top edge to said base edge such that the distance between the screen and side wall increases gradually from said top edge to said base edge, the base edge 12, 35 and the top edge 13, 36 of the step subtending a very small angle Ω with said longitudinal axis in such manner that the step 14, 37 slopes toward the surface of the screen 5, 29, an angle α of this slope relative to a radial plane 15, 38 extending through the base of the step to the axis, being between 5° and 80°, the element 8, 80 being mutually rotationally offset about the axis 6, 30 by an angle β measured between the radial planes of adjacent elements, the angle β of a magnitude of at least 360°/n, where n is at least 3.

2. Rotor defined in claim 1, wherein n=3, the elements being offset by 120° and the spiral segment winding over 120°.

3. Rotor defined in claim 1, wherein n=4, the elements being offset by 90° and the spiral segment winding over 90°.

4. Rotor defined in claim 1, characterized in that at least one element 8, 80 comprises at least one deflecting device 16 displacing the pulp in the longitudinal direction.

5. Rotor defined in claim 1, characterized in that each element 8, 80 comprises at least one blade 16 opposite the step 14, 37 relative to the rotor axis 6, 30, said blade extending along the wall of the element 8, 80 and subtending an angle δ between 1° and 15° with the plane 17 perpendicular to the longitudinal rotor axis 6, 30.

6. Rotor defined in claim 5, characterized in that the leading edge 20 of the blade 16 slopes at an angle ϕ of about 60°.

7. Rotor defined in claim 1, characterized in that the step 14, 37 subtends an angle θ approximately between −15° and +15° with the direction of the longitudinal axis 6, 30.

8. Centrifugal rotor defined in claim 1 and configured as a generally cylindrical closed drum and mounted coaxially with the screen inside the hollow cylinder of said screen, characterized in that the slop α of the step 14 is between 10° and 30°.

9. Equipment for the hydrodynamic purification of paper pulp comprising a closed tank 1, 25 containing at least one cylindrical, stationary screen 5, 29 separating two chambers, and a rotor 7, 31 coaxial (6, 30) with the screen, characterized in that the rotor further comprises a generally cylindrical case extending along a longitudinal axis of rotational 6, 30 and comprising a sequence of n identical elements 8, 80 located side-by-side along the longitudinal axis 6, each 8, 80 being cylindrical, a side wall of each element 8, 80 having a step 14, 37, said step forming a base edge 12, 35 and a top edge 13, 36, on either side of the step, the side wall gradually spirally winding around the longitudinal axis 6, 30 over at least 360° from said top edge to said base edge such that the distance between the screen and side wall increases gradually from said top edge to said base edge, the base edge 12, 35 and the top edge 13, 36 of the step subtending a very small angle Ω with said longitudinal axis in such manner that the step 14, 37 slopes toward the surface of the screen 5, 29, an angle α of this slope relative to a radial plane 15, 38 extending through the base of the step to the axis, being between 5° and 80°, the elements 8, 80 being mutually rotationally offset about the axis 6, 30 by an angle β measured between the radial planes of adjacent elements, the angle β of a magnitude of at least 360°/n, where n is at least 3.

10. Equipment defined in claim 9, characterized in that the distance between the screen 5, 29 and the step top 13, 35 is approximately between 1 and 5 mm.

11. A centripetal rotor for the pressurized hydrodynamic purification of paper pulp from old papers in known purification equipment using a cylindrical screen, comprising:

a generally cylindrical case extending along a longitudinal axis of rotation 30 and comprising a sequence of n identical elements 80 located side-by-side along the longitudinal axis 30, each element 80 being cylindrical, an inner side wall 34 of each element 8, 80 having a step 37, said step forming a base edge 35 and a top edge 36, on either side of the step, the side wall gradually spirally winding around the longitudinal axis 30 over at least 360° from said top edge to said base edge such that the distance between the screen and side wall increases gradually from said top edge to said base edge, the base edge 35 and the top edge 36 of the step subtending a very small angle Ω with said longitudinal axis in such manner that the step side 37 slopes toward the surface of the screen 29, an angle α of this slope relative to a radial plane 38 extending through the base of the step to the axis, being between 5° and 80°, the elements 80 being mutually rotationally offset about the axis 30 by an angle α measured between the radial planes of adjacent elements, the angle β of a magnitude of at least 360°/n, where n is at least 3, an outer body wall 33 of the tubular body being cylindrical and of circular cross section.

12. Centripetal rotor defined in claim 11, characterized in that the slope α of the step 37 is between 10° and 60°.

* * * * *